United States Patent [19]

Morell et al.

[11] Patent Number: 4,910,890

[45] Date of Patent: Mar. 27, 1990

[54] ALPINE SKI BOOT HAVING A SUPPORTING FLEXION ELEMENT AND INTERNAL FOOT TIGHTENING APPARATUS

[75] Inventors: Joseph Morell, Annecy; Louis Benoit, Frangy; Bernard Nerrinck, Vincy, all of France

[73] Assignee: Salomon S.A., Annecy Cedex, France

[21] Appl. No.: 61,812

[22] Filed: Jun. 15, 1987

Related U.S. Application Data

[63] Continuation-in-part of Ser. No. 870,532, Jun. 4, 1986.

[30] Foreign Application Priority Data

Jun. 20, 1986 [FR] France ..... 86 09557

[51] Int. Cl.[4] ..... A43B 5/04

[52] U.S. Cl. ..... 36/117; 36/120

[58] Field of Search ..... 36/117–121

[56] References Cited

U.S. PATENT DOCUMENTS

| | | | |
|---|---|---|---|
| 3,619,914 | 11/1971 | Hanson et al. . | |
| 3,738,025 | 6/1973 | Hanson et al. . | |
| 3,848,347 | 11/1974 | Hanson et al. . | |
| 3,988,842 | 11/1976 | Rathmell . | |
| 4,095,356 | 6/1978 | Robran et al. . | |
| 4,282,658 | 8/1981 | Hanson et al. . | |
| 4,317,297 | 3/1982 | Hanson . | |
| 4,381,613 | 5/1983 | Lederer | 36/121 |
| 4,455,768 | 6/1984 | Salomon | 36/121 |
| 4,557,061 | 12/1985 | Graillat et al. . | |
| 4,557,420 | 3/1986 | Petrini et al. . | |
| 4,575,956 | 3/1986 | Paris | 36/119 |
| 4,580,358 | 4/1986 | Pozzobon | 36/119 |
| 4,620,380 | 11/1986 | Aldino . | |
| 4,669,203 | 6/1987 | Sartor | 36/120 |
| 4,693,020 | 9/1987 | Salas et al. | 36/117 |
| 4,694,593 | 9/1987 | Petrini et al. | 36/120 |
| 4,769,930 | 9/1988 | Morell et al. | 36/117 |

FOREIGN PATENT DOCUMENTS

| | | | |
|---|---|---|---|
| 0329407 | 5/1976 | Austria . | |
| 0339772 | 11/1977 | Austria . | |
| 0172159 | 2/1986 | European Pat. Off. | 36/121 |
| 2037248 | 2/1971 | Fed. Rep. of Germany . | |
| 2404447 | 8/1974 | Fed. Rep. of Germany . | |
| 2410515 | 9/1974 | Fed. Rep. of Germany . | |
| 1817998 | 2/1977 | Fed. Rep. of Germany . | |

(List continued on next page.)

OTHER PUBLICATIONS

U.S. Ser. No. 810,532, 06041986, Morell et al.

*Primary Examiner*—James Kee Chi

*Attorney, Agent, or Firm*—Sandler & Greenblum

[57] ABSTRACT

A ski boot including a rigid shell base and a cuff journalled to the shell base. A manipulation lever for adjusting the fit of the boot, the manipulation lever being positioned at an upper zone of the shell base. At least one flexion element having a space for receiving the manipulation lever, the flexion element being associated with an upper surface of the shell base and cooperating with the cuff. The flexion element being mounted transversely to a longitudinal axis of the boot and being adapted to extend over at least a portion of the periphery of the foot of a skier using the boot over a zone extending along the flexion fold of the instep of the skier. The cuff having a lower edge adapted to cooperate with an upper surface of the shell base via at least one flexion element, the flexion element being in continuous supporting contact with the lowered cuff edge at least along the longitudinal axis of the boot. An internal foot tightening apparatus for adjusting the fit of the boot. The flexion element comprising an extension portion positioned at least partially on the zone of the shell base. A flexion element for use with a ski boot having a fit adjustment apparatus, the flexion element being adapted to be positioned on an upper surface of the boot. The fit adjustment apparatus being controlled by a manipulation lever which fits into a space in the flexion element.

41 Claims, 5 Drawing Sheets

FOREIGN PATENT DOCUMENTS

| | | | |
|---|---|---|---|
| 2730364 | 1/1978 | Fed. Rep. of Germany . | |
| 3618923 | 12/1986 | Fed. Rep. of Germany | 36/121 |
| 3619043 | 12/1986 | Fed. Rep. of Germany | 36/117 |
| 2096248 | 2/1972 | France . | |
| 2100490 | 3/1972 | France . | |
| 2103171 | 4/1972 | France . | |
| 2166677 | 8/1973 | France . | |
| 2184322 | 12/1973 | France . | |
| 2220201 | 10/1974 | France . | |
| 2256734 | 8/1975 | France . | |
| 2276851 | 1/1976 | France . | |
| 2278280 | 2/1976 | France . | |
| 2371162 | 6/1978 | France . | |
| 2416661 | 9/1979 | France . | |
| 2480575 | 10/1981 | France . | |
| 2495901 | 6/1982 | France . | |
| 2539278 | 7/1984 | France . | |
| 2484800 | 12/1984 | France . | |
| 2546726 | 12/1984 | France . | |
| 2547206 | 12/1984 | France | 36/119 |
| 2555418 | 5/1985 | France . | |
| 2576192 | 7/1986 | France | 36/117 |

ALPINE SKI BOOT HAVING A SUPPORTING FLEXION ELEMENT AND INTERNAL FOOT TIGHTENING APPARATUS

RELATED APPLICATION

This application is a Continuation-In-Part application of Ser. No. 870,532, filed June 4, 1986.

The present invention relates to an improvement of a ski boot as disclosed in French Patent Application 85 09179, corresponding to U.S. patent application Ser. No. 870,532, commonly owned with the present application, the disclosure of which is hereby incorporated by reference thereto.

BACKGROUND OF THE INVENTION

1. Field of the Invention

The present invention relates generally to boots, and more particularly to boots which include a molded shell base adapted to surround the foot of a wearer and by an upper which may be molded as one or more portions adapted to surround the lower leg of the wearer, wherein the upper is journalled on the shell base. Specifically, the present invention is directed to an apparatus for adjusting the flexional characteristics of the upper of a boot with respect to the shell base of the boot.

2. Description of Relevant Materials and Prior Art

Attempts have been made to provide conventional rigid ski boots with good flexional properties without compromising their capability of transmitting forces and permitting skiers to control their skis. A representative example of this type of boot construction is disclosed, for example, in French Patent Application No. 2,276,851. In this French application a ski boot is illustrated in which flexion control is achieved by deforming and extending the lower edge of a portion of the upper which cooperates with the upper surface of a rigid shell base during forward flexional movements of the leg of a skier.

Related to this, conventional rear entry boot constructions are designed with uppers which have, located at the bottom of their front zones, a type of slot which is positioned in transverse fashion to the longitudinal axis of the boot so as to define a lower border for the upper which serves as a deformation band which will extend or stretch during forward flexion of the leg of a skier. In such constructions, the band can be provided with predetermined elasticity, dependent upon the nature of the material used to form the upper.

These types of ski boot constructions are commonly referred to as "rear-entry boots" because entry of the foot of the skier is through the rear of the boot. Rear-entry boots include a rigid shell base without any opening on the front of the foot. Although such construction provides good shock absorption characteristics for the upper, such constructions do not permit the necessary elastic return that a skier normally expects from the boot.

Accordingly, attempts have been made to overcome such disadvantages by providing ski boots with an upper having progressively adjustable flexional characteristics, and yet are capable of preventing extreme flexions which would exceed limits provided by the anatomy of the connection between the lower leg and the foot of a skier.

To this end, French Patent No. 2,480,575 discloses a boot having an apparatus for adjusting the flexional characteristics of a ski boot. The flex adjusting apparatus is positioned at the lower periphery of the upper and includes a support surface provided on the upper which is capable of transmitting flexional forces of the leg to a flexion element which is adapted to cooperate with the shell base of the boot via at least one abutment which is slidably mounted within a guide. The flex adjusting apparatus is thus capable of modifying the conditions under which the forces are transmitted as a function of the positions occupied by each of the abutments while they are being guided.

A substantially similar type of construction is disclosed in French Pat. No. 2,484,800, in which the flexion element is spaced from the lower edge of the upper so as to form a transverse slot. The lot is, in turn, interrupted by a supporting abutment which ensures direct contact between the lower edge of the upper and the flexion element during forward flexional movements of the boot.

In both of these cases, the abutments, which may or may not be slidable, are positioned along both sides of the mean longitudinal plane of the boot. Alternately, a single abutment can be provided along one side of the plane of the boot. Such arrangements, however, can lead to unbalanced flexions along either side of the mean longitudinal plane. This tends to pose a problem because expert and other particularly demanding skiers require that the majority of flexion occur along the mean longitudinal plane of the boot.

Accordingly, the present invention overcomes the previously discussed disadvantages of the prior art by causing the forces transmitted from the edge of the upper to the flexion element to occur along the longitudinal axis of the ski boot in addition to permitting an adjustment of the forces which re transmitted.

SUMMARY OF THE INVENTION

The present invention is directed to a ski boot provided with a flexion element across the instep of the boot adapted to receive a manipulation lever operably connected to a fit adjusting mechanism associated with the boot.

The flexion element adapted to be attached to the outer shell of a ski boot is a generally elongate member having a length sufficient to extend from an area of the shell base in the vicinity of the arch of the foot over the instep towards the opposite side of the shell base. Preferably the elongate member is provided with a space, as a recess or a hollow area, adapted to receive the manipulation lever associated with the fit adjustment mechanism of the ski boot.

In one embodiment, the flexion element includes means for linking the flexion element to the ski boot which is attached to the manipulation lever, preferably wherein the space in the elongate member is defined in part by a wall and the means for linking includes an opening in the wall to permit the passage of a threaded journal attached to the manipulation lever. Related to this, the elongate member of the flexion element in accordance with the present invention preferably includes an extension portion in which the previously described space is located.

In another embodiment, the elongate member of the flexion element includes an upper arm and a lower arm, preferably defining an intermediate slot adapted to receive means for varying the flex of the flexion element adjustably positioned in the slot.

In each of these embodiments, the flexion element is adapted to be attached at one end, i.e., the end of the elongate member of the flexion element adjacent the arch of the foot, to the ski boot whereas the opposite end may alternatively be free or adapted to be attached to the ski boot. In the latter instance, the means for linking the flexion element to the shell base of the ski boot may be in the form of a rivet capable of being inserted into an appropriate support, i.e., an opening, on the shell base of the boot. Alternatively, the means for linking the flexion element to the shell base includes a male element adapted to be inserted into a female element provided on the shell base of the ski boot, preferably wherein the male element is a tongue extending from the extension portion of the flexion element and th female element is an opening in the shell of the ski boot adapted to receive the tongue.

The previously described flexion element in accordance with the present invention is particularly suitable for use with ski boots composed of a shell base having a longitudinal axis and an exterior surface area, and a cuff journalled to the rigid shell base having a lower edge, and a manipulation lever adapted to cooperate with an internal foot tightening apparatus, wherein the flexion element is mounted transversely to the longitudinal axis of the shell base and is adapted to extend over at least a portion of the shell base in a manner which permits the flexion element to contact the lower edge of the cuff. Preferably, the shell base of the ski boot to which tee flexion element of the present invention is attached includes a recess having a support shoulder adapted to receive at least a part of the extension portion of tee flexion element, preferably wherein the support shoulder includes a wall of the recess which has a maintenance edge, and the extension portion of the flexion element nests in the recess and abuts against the maintenance edge. The shell base of the ski boot may also include an access opening adapted to be closed by at least a portion of the extension portion of the flexion element.

BRIEF DESCRIPTION OF DRAWINGS

The characteristics of the invention and its particular advantages which are claimed will become clear from the description which follows, with reference to the schematic annexed drawings, showing by way of non-limiting example, several embodiments in which:

FIG. 1 illustrates the boot provided with the flexion element which simultaneously constitutes the closure spoiler of the shell base in the zone of the internal foot tightening apparatus of the boot.

FIG. 2 illustrates the flexion element alone equipped with the manipulation lever which is affixed thereto, thus constituting a mounting subassembly.

FIG. 6 illustrates a detail of the assembly on the shell base of the boot, along the line of cross-section VI—VI of FIG. 5.

DESCRIPTION OF PREFERRED EMBODIMENTS

Figure 1:
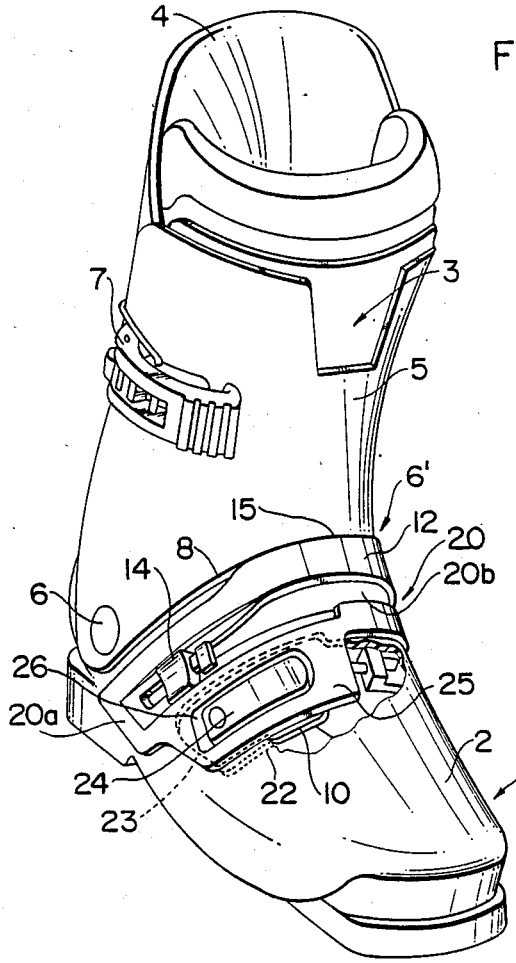
FIGS. 1 and 2 illustrate a first embodiment of the invention in which the flexion element includes an extension position on the exterior of the shell base of the boot and which integrates the manipulation lever of an internal tightening apparatus of the boot.

The ski boot according to the present application includes a rigid shell base on which a cuff is journalled. The cuff has a lower edge which cooperates with the upper surface of the shell base by means of at least one flexion element mounted transversely with respect to the longitudinal axis of the boot. In the embodiments described in more detail herein below, the flexion element is situated generally facing the zone of th foot which extends from the flexion fold to the instep of the foot and on the portion of the periphery of the foot up to the proximity of its sides, substantially adjacent to the journal axis of the boot. This arrangement gives complete satisfaction with respect to the technical results obtained. For certain types of constructions, however, the space available between the lower edge of the cuff and the support surface of the flexion element on the shell base is relatively limited. In effect, in the case here the boot is adapted to receive an internal tightening apparatus on the front of the boot, having a manipulation element situated on the shell base in a zone adjacent to the support shoulder, the free space adapted to receive the flexion apparatus tends to cause constructional constraints on the flexion apparatus.

The goal of the present application, therefore, is to avoid this type of constraint, such as diminution of the sections of the flexion band constituting the apparatus and increase of their assembly zone with the shell base. These goals are achieved by constructing a boot according to the parent application U.S. Ser. No. 870,532, the disclosure of which is hereby incorporated by reference thereto, to have a flexion element, or at least one of its constituent portions, adapted to receive a manipulation lever of the internal tightening apparatus of the boot in a space provided in a portion of the flexion element between the adjustment slid and the support shoulder on the shell base of the boot.

FIGS. 1–7 illustrate a ski boot according to the present invention embodying the inventive features of the ski boot disclosed and claimed in parent application U.S. Ser. No. 870,532. In this regard, a ski boot 1 is constructed to have a shell base 2 formed from rigid plastic material on which an upper 3 is journalled, the upper 3 being adapted to surround the lower leg of a skier. The upper 3 includes a rear portion or spoiler 4 and a front portion or cuff 5. In the embodiment illustrated, rear spoiler 4 and cuff 5 are simultaneously journalled to the shell base along a single axis 6, 6' (not shown) which is positioned substantially along the zone of the maleolli of the skier. Such an arrangement permits entry of the foot of a skier into the rear of the ski boot. A closure device in the form of a buckle 7 is provided along an upper portion of the boot upper and permits tightening of the spoiler 4 and cuff 5 of upper 3 about the lower leg of a skier. Cuff 5 terminates towards the bottom of shell 2 a lower edge 8. The lower edge of the cuff is located above the flexion fold of the foot of a skier, extends towards the rear of the boot, and surrounds the top of the foot of the skier until the ends of the lower edge reach points adjacent an area about axis 6, 6'. The lower edge 8 of cuff 5 cooperates With the exterior surface of the shell base 2 via a flexion element 20 which i mounted transversely with respect to the longitudinal axis (not shown) of the ski boot. This is achieved by surrounding or enclosing at least one portion of the top of the foot of the skier along a zone which extends along the flexion fold of the instep of the skier.

In all of the embodiments of the present invention, the flexion element 20, which extends between cuff 5 and shell base 2, is attached to the shell base in the vicinity of the arch of the foot. The attachment points for the flexion element are located just forwardly of journal axis 6, 6' by linkage means 110, for example in the form of rivets, staples, elastic attachments, or fittings. Alternatively, the flexion element may be welded to the shell base of the boot, for example using ultrasound welding techniques. The linkage means for connecting the flexion element to the shell base are preferably capable of being disassembled in order to permit flexion element 20 to be easily detached from the shell base and/or interchanged with a different flexion element. As illustrated in FIG. 1, however, free end **20*a* of the flexion element can remain unattached and yet be maintained in position against edge 10**.

As illustrated, flexion element 20 includes a slot **20*b* which divides the flexion element into two substantially parallel, distinct arms 12 and 13, about the periphery of a foot of a skier. More specifically, flexion element 20 is divided into an upper arm 12 upon which cuff 5 rests when the flexion element is attached to the boot, and a lower arm 13 which rests on a shoulder of shell base 2. An abutment or cursor 14 is adjustably positioned within the slot for purposes of varying the flex of the flexion element depending upon its position. Preferably, the abutment 14** is moveably disposed within the slot to slide from one side of the slot to the other for this purpose. In this regard, maximum flexing is obtained when the abutment is positioned at either extreme end of the slot and provides the greatest resistance to flexing when positioned at a midpoint along a central longitudinal axis of the ski boot. Normally, the position of the abutments or cursors are changed when a skier is in a stationary position. The cursors and slots can be of the type disclosed in previously-mentioned French Patent No. 2,880,575.

According to an essential characteristic of the present invention, flexion element 20 cooperates with lower edge 8 of cuff 5 along the level of the longitudinal axis of the boot, i.e., at a substantially central position of the cuff and flexion element. In the embodiment illustrated in FIGS. 1 and 2, upper arm 12, i.e., the active flexion portion of flexion element 20, creates a zone adjacent the midpoint of the flexion element which is configured so as to assure, together with edge 8, a substantially linear abutment support 15. In the embodiment shown in FIG. 3, on the other hand, upper arm 12 is provided with an extended portion in the form of a substantially punctual abutment support **15*a* which engages a central narrower area or point of cuff edge 8**.

Figure 7:
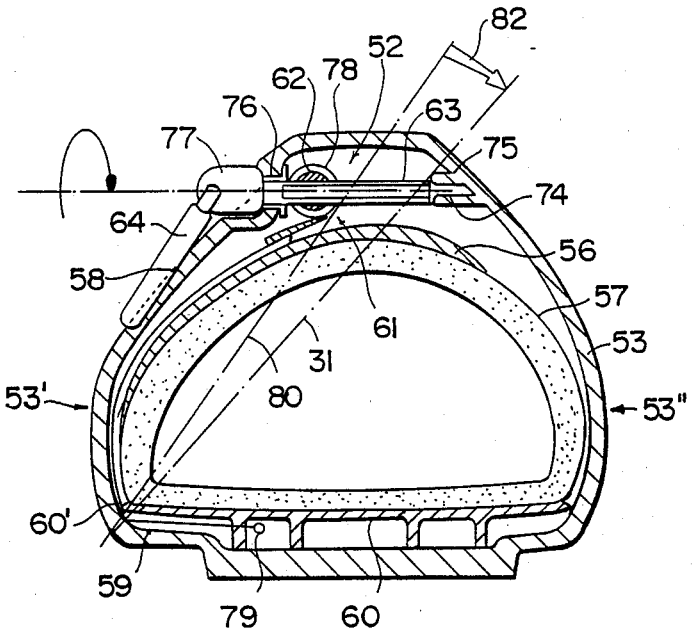
FIG. 7 illustrates a representative, non-limiting example of an internal foot tightening apparatus and its manipulation lever suitable for use in accordance with the present invention.

The flexion element 20 also includes an extension portion 25 of its lower arm 13 which extends on the shell base 2 beyond a manipulation lever 24 associated with an internal foot tightening apparatus. A representative example of an internal foot tightening apparatus suitable for purposes of the present invention is disclosed in U.S. Pat. No. 4,557,061, commonly owned with the present application, the disclosure of which is hereby incorporated by reference thereto. Referring to FIG. 7 which illustrates such an internal tightening apparatus, the foot retention system 52 is positioned on the interior of the rigid shell generally in the zone corresponding to the lateral external surface of the upper portion of the foot. The system includes a support element or distribution plate 56 for distributing the tightening forces on the foot which covers, according to a preferred embodiment, the entire upper portion of the foot as well as its external lateral side. Distribution plate 56 is interposed between shell 2 and the external slipper walls 57. An adjustable tightening apparatus acting on the plate 56 is composed of a combination of a nut bolt system and a strap 58 which is flexible and inelastic. This strap is attached at its lower end 9 to inner sole 10. Inner sole 60 is itself integral with shell base 2 of the boot. The attachment zone of the lower end 59 of strap 58 is situated on the external lateral side 53' of the boot while the upper end 61 is connected to control means constituted by a nut 62 moving along a bolt 63 positioned to move transversely to the longitudinal axis in the upper portion of the internal volume of shell base 2. Bolt 63 is rotatably movable from the exterior of the shell by a manipulation lever 64 positioned on the external side 53' of the boot. During rotation of bolt 53 to affect tightening, screw 52 is moved along the internal side 53'' of the boot and strap 58 to form an arc which tends to come closer to the cord defined by its lower end 59 and upper end 61, this latter being displaced with screw 62 to which it is connected. By this action, the foot is simultaneously pressed on the inner sole 60 and against the lateral internal wall 53'' the boot which thus provides a good retention and a good feeling of contact between the foot and the boot.

The internal foot tightening device illustrated in FIG. 7 is adapted for use with foot retention system 52. Thus, manipulation bolt or screw 63 which is rotatable includes at one of its ends a swivel or pin 74 which is clipped between two bosses 75 on the interior of the shell base while the other end extends through a hole 76 on the other side of the shell and is provided with a ferrule 77 made of plastic material serving as a bearing ring This ferrule furthermore assures the linkage between manipulation lever 64 and screw 63 in a conventional manner. Nut 62 moves along bolt 63 which receives latching buckle 78 of strap 58. Strap 58 is connected to shell base 2 through inner sole 60 to which it is attached. Assembly means 79, conventional in itself, provides for the attachment of the strap at end 59 of the sole and is preferably positioned in the vicinity of the lateral external edge 60' of the sole. Thus, in its free position, flexible strap 58, made of braided synthetic fibers, itself matches the contour of the upper portion of the external lateral side of the inner boot and describes a sort of arch positioned on the external half of the upper portion of the foot. The fixed anchorage point of the strap positioned in the vicinity of edge 60' of the inner sole and the linkage of latching buckle 78 of the strap with nut 62 define an oblique cord 80 with respect to the plane of the inner sole. In the course of movement of bolt 62 towards internal surface 53'' of the boot, this oblique cord 80 will move to a final position indicated at 81 such that the initial arch formed by strap 58 will stretch and match with the cord i the final position. Arrow 82 thus indicates the possible extent of tightening between the two position.

The extension portion forms a closure spoiler of the shell base 2 in a zone in the vicinity of the tightening apparatus by closing access opening 23 to the internal tightening apparatus by means of one linkage means 110 including a maintenance edge provided in the shell base. The extension portion nests on the corresponding wall 22 which constitutes, at this location, the support shoulder of the shell base. In this example, the manipulation lever 24 is connected to the flexion element 20. A recess or seat 26 is provided in extension portion 25 of the flexion element in a manner which permits the outer surface of the manipulation lever to be substantially flush with the outer surface of the extension portion of the flexion element.

Figure 3:
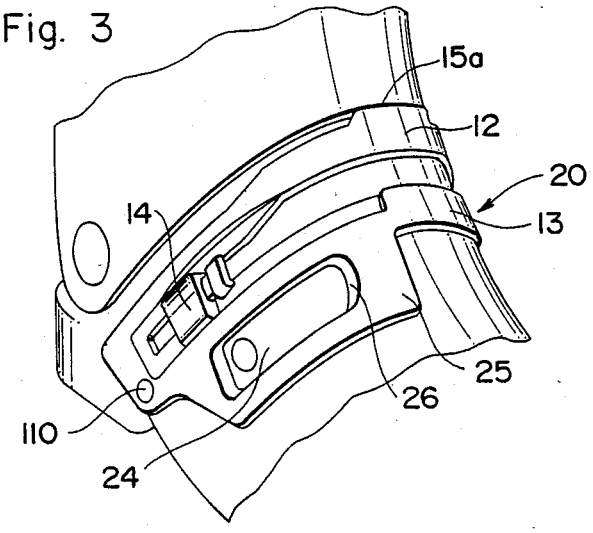
FIG. 3 is a partial perspective view of a ski boot in which the flexion element according to the invention includes a protuberance which constitutes a support with the lower edge of the cuff.
Figure 2:
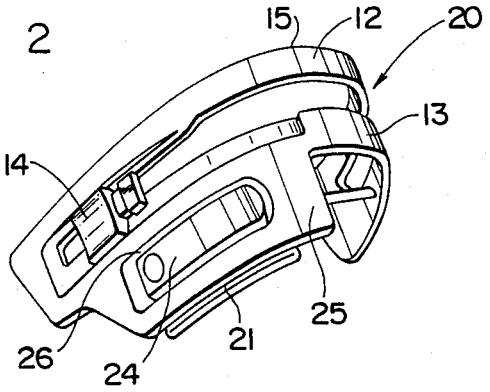

As previously discussed, upper arm 12 cooperates with lower edge 8 of cuff 5 by providing, in view of its design, a point abutment support 15*a*, as illustrated in FIG. 3, or a linear abutment support 15, as shown in FIGS. 1 and 2.

Figure 4:
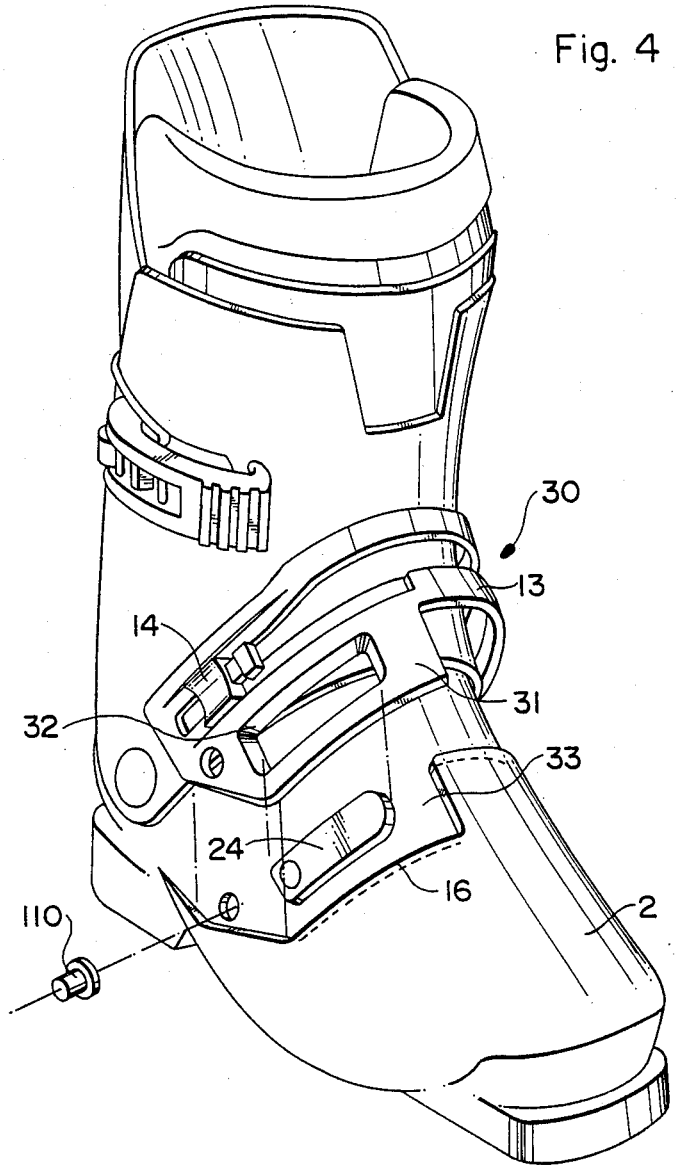
FIG. 4 illustrates a ski boot provided with a flexion element according to a second embodiment.
Figure 6:
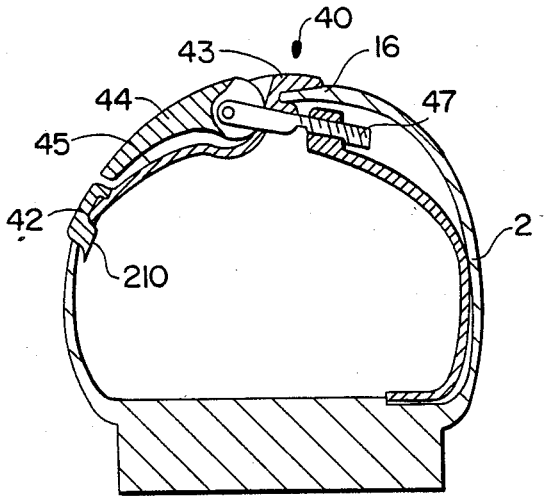
FIGS. 5 and 6 illustrate a third embodiment of the flexion element.
Figure 5:
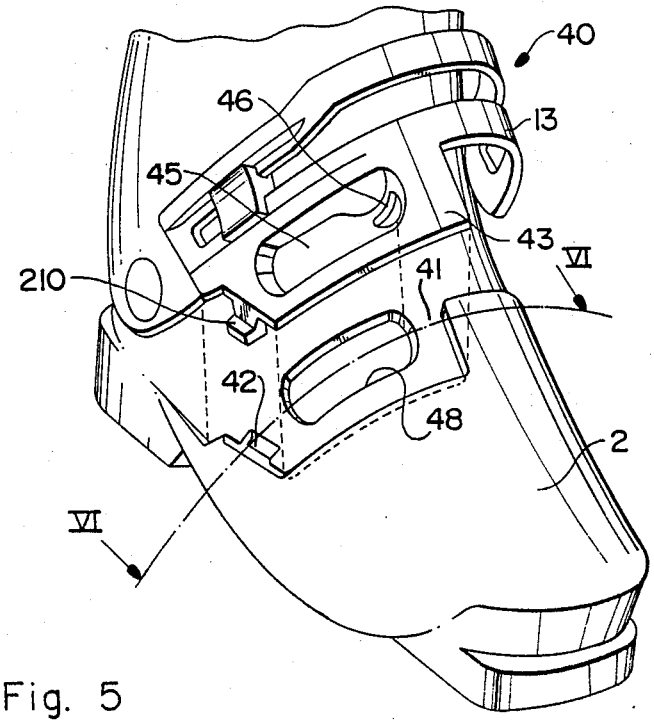

According to a second embodiment of the invention, illustrated in FIG. 4, the flexion element 30, and preferably lower arm 13 of the flexion element, includes extension portion 31 provided with an opening 32 adapted to permit the passage of the manipulation lever 24 completely through the opening. Shoulder 16 for support of lower arm 13 of the flexion element, and thus of its extension portion 31, is formed by th wall of recess 33 provided in shell base 2. As illustrated, flexion element 30 is retained on the shell base by means of conventional linkage means 110, shown as rivets in this example, which may be positioned on both sides of the flexion element. The linkage means are preferably removable so as to allow for interchangeability of the flexion element 30 as needed or desired A third embodiment of the invention is shown in FIGS. 5 and 6 and constitutes a partial combination of the characteristics of flexion elements 20 and 30 described with reference to the preceding Figures. In this example, flexion element 40 includes a lateral extension 43 designed to be positioned in a recess 41 provided on shell base 2. Linkage means 210, such as male members or tongues, which may be positioned on both sides of the boot, are hooked or otherwise inserted into corresponding female members or openings 42 provided on the shell base. Support shoulder 16 for lower arm 13 of the flexion element is formed, as previously described, by the wall of recess 41. The manipulation lever 44 of the internal tightening apparatus of the boot, shown in FIG. 6, is integrated with flexion element 40 which is provided with a space 45 adapted to receive lever 44 and is provided with a complementary shape for this purpose. An opening 46 is provided in the wall of space 45 for the passage of the threaded axis 47 of the lever. Corresponding with space 45, a cutaway of passage 48 is provided in shell base 2 to permit the connection or threaded axis 47 with the other constituent elements of the internal tightening apparatus of the boot as well as the partial introduction of extension portion 43 of flexion element 40 in the recess of shell base 2.

In all of the various embodiments described and illustrated above, it would be obvious to one of ordinary skill in the art that a certain number of constructional features could be combined in different manners; and such detailed structures do not require additional description herein. Further, although the present invention has been described with respect to particular means, materials and embodiments, it is to be understood that it would be within the scope of one of ordinary skill in the art that the invention is not limited to the particular features and embodiments disclosed, and that it extends to all equivalents within the scope of the claims.

I claim:

1. A ski boot comprising:

(a) a rigid shell base having a longitudinal axis and an upper surface;

(b) a cuff journalled to said rigid shell base having a lower edge; and (c) at least one flexion element mounted transversely to said longitudinal axis of said rigid shell base, and adapted to extend over at least a portion of said rigid shell base, wherein said flexion element is in contact with said lower edge of said cuff; and is separate from said cuff, said flexion element further comprising a space therein; said (d) a manipulation lever located within said space at said flexion element and adapted to cooperate with an internal foot-tightening apparatus.

2. The ski boot according to claim 1, wherein said flexion element includes an extension portion in which said space is located.

3. The ski boot according to claim 2, wherein said flexion element is adapted to extend over an area above the flexion fold of the instep of a skier.

4. The ski boot according to claim 3 wherein said flexion element comprises an upper arm and a lower arm, said extension portion being provided on said lower arm.

5. The ski boot according to claim 4 wherein said upper surface of said shell base comprises a recess having a support shoulder adapted to receive at least a part of said extension portion.

6. The ski boot according to claim 5, wherein said support shoulder comprises a wall of said recess having a maintenance edge, and said extension portion nests in said recess and abuts said maintenance edge.

7. The ski boot according to claim 6, wherein said shell base comprises an access opening adapted to be closed by at least a portion of said extension portion.

8. The ski boot according to claim 7, further comprising means for linking said flexion element to said shell base.

9. The ski boot according to claim 8, wherein said linking means comprises at least one rivet attached to said shell base.

10. The ski boot according to claim 8, wherein said linking means comprises attachment means including a male member and a female member positioned cooperatively on one of each of said flexion element and said shell base.

11. The ski boot according to claim 10, wherein said male member is a tongue and said female member is an opening, wherein said tongue is adapted to be hooked into said opening.

12. A boot comprising;

(a) a shell base having an upper surface, (b) a cuff journalled to said shell base, (c) a manipulation lever separate from said cuff, for adjusting the fit of said boot located on an area of said upper surface of said shell base, and (d) at least one flexion element mounted to said shell base transversely with respect to a longitudinal axis of said boot and having a space for receiving said manipulation lever.

13. A boot according to claim 12, wherein said flexion element is adapted to extend over at least a portion of a periphery of a foot of a wearer through a zone extending along a flexion fold of the instep of said wearer.

14. A boot according to claim 12 wherein said manipulation lever is attached to said flexion element.

15. A boot according to claim 15 wherein said space in said flexion element comprises a recess.

16. A boot according to claim 12 wherein said manipulation lever is attached to said shell base.

17. A boot according to claim 16 wherein said space in said flexion element comprises a hollow portion, and said manipulation lever extends through said hollow portion.

18. A boot according to claim 13, further comprising linking means for linking said flexion element to said shell base.

19. A boot according to claim 18, wherein said linking means is attached to said manipulation lever.

20. A boot according to claim 19, wherein said linking means comprises at least one rivet being supported on said shell base.

21. A boot according to claim 18, wherein said linking means comprises attachment means on one of said flexion element an said shell base for cooperating with at least one attachment opening on the other of said flexion element and said shell base.

22. A boot according to claim 12, wherein said flexion element comprises an extension portion provided with said space.

23. A boot according to claim 22, further comprising means for linking said flexion element to said shell base, wherein said manipulation lever fits into said space in said extension portion and is attached to said flexion element.

24. A boot according to claim 23, wherein said space is defined by a wall and said linking means comprises an opening in said wall of said space, and a threaded journal attached to said manipulation lever and passing through said opening.

25. A boot according to claim 22, wherein said upper surface of said shell base comprises a recess having a support shoulder adapted to receive at least a part of said extension portion.

26. A boot according to claim 25, wherein said support shoulder comprises a wall of said recess including a maintenance edge, said extension portion being nested in said recess and abutting said maintenance edge.

27. A boot according to claim 12 wherein said cuff comprises a lower edge adapted to cooperate with said upper surface of said shell base by means of said at least one flexion element.

28. A boot according to claim 27, wherein said at least one flexion element is in continuous supporting contact with said lower edge of said cuff.

29. A boot according to claim 12 wherein said flexion element comprises an upper arm and a lower arm.

30. A boot according to claim 29, wherein said upper arm and said lower arm define an intermediate slot.

31. A boot according to claim 30, further comprising means for varying the flex of said flexion element adjustably positioned in said slot.

32. A boot according to claim 12 wherein said boot comprises an internal foot tightening apparatus for adjusting said fit of said boot connected to said manipulation lever.

33. A flexion element adapted to be positioned on an upper surface of a boot having a fit adjustment apparatus controlled by a manipulation lever, said flexion element comprising an elongate member having a space adapted to receive said manipulation lever, and an upper portion and a lower portion defining a slot between said upper portion and said lower portion.

34. A flexion element according to claim 33, further comprising means for linking said flexion element to said boot, said linking means being attached to said manipulation lever.

35. A flexion element according to claim 34, wherein said space is defined in part by a wall in said elongate member, and said linking means comprises an opening in said wall and a threaded axis attached to said manipulation lever and passing through said opening.

36. A flexion element according to claim 33, wherein said elongate member comprises an extension portion, said space being positioned in said extension portion.

37. A flexion element according to claim 38, wherein said elongate member comprises an upper arm and a lower arm.

38. A flexion element according to claim 37, wherein said upper portion is an upper arm said lower portion is a lower are, and wherein said slot is an intermediate slot which is positioned between said upper arm and said lower arm.

39. A flexion element according to claim 38, further comprising means for varying the flex of said flexion element adjustably positioned in said slot.

40. A flexion element according to claim 37, wherein said extension portion is attached on said lower arm.

41. A boot comprising:

(a) a shell base;
(b) a cuff journalled to said shell base;
(c) a manipulation lever for adjusting the fit of said boot; and
(d) at least one flexion element mounted to said shell base transversely with respect to a longitudinal axis of said boot and having a first space for enabling flexion of said flexion element, and a second space for receiving said manipulation lever.

* * * * *

UNITED STATES PATENT AND TRADEMARK OFFICE

CERTIFICATE OF CORRECTION

PATENT NO. : 4,910,890

DATED : March 27, 1990

INVENTOR(S) : J. MORELL et al.

It is certified that error appears in the above-identified patent and that said Letters Patent is hereby corrected as shown below:

Column 2, line 15, change "lot" to ---slot---.
Column 2, line 36, change "re" to ---are---.
Column 3, line 15, change "th" to ---the---.
Column 3, line 29, change "tee" to ---the---.
Column 3, line 32, change "tee" to ---the---.
Column 4, line 18, change "th" to ---the---.
Column 4, line 27, change "here" to ---where---.
Column 4, line 45, change "slid" to ---slide---.
Column 4, line 65, insert "at" after "2".
Column 5, line 2, change "With" to ---with---.
Column 5, line 4, change "i" to ---is---.
Column 5, line 47, change "2,880,575" to ---2,480,575---.
Column 6, line 34, insert ---of--- before "the boot".
Column 6, line 45, insert ---.--- after "ring".
Column 6, line 63, change "62" to ---63---.
Column 6, line 66, change "i" to ---in---.
Column 7, line 27, change "th" to ---the---.
Column 7, line 54, change "of" to ---or--- after "cutaway".
Column 7, line 55, change "or" to --of--.

UNITED STATES PATENT AND TRADEMARK OFFICE

CERTIFICATE OF CORRECTION

PATENT NO. : 4,910,890

DATED : March 27, 1990

INVENTOR(S) : J. MORELL et al.

It is certified that error appears in the above-identified patent and that said Letters Patent is hereby corrected as shown below:

Column 8, line 18, in claim 1, line 13, change "at" to ---of--- after "space".

Column 9, line 6, in claim 15, line 1, change "claim 15" to ---claim 14---.

Column 9, line 14, in claim 18, line 1, change "claim 13" to ---claim 12---.

Column 9, line 19, in claim 20, line 1, change "claim 19" to ---claim 18---.

Column 9, line 24, in claim 21, line 3, change "an" to ---and---.

Column 10, line 31, in claim 37, line 1, change "claim 38" to ---claim 36---.

Column 10, line 35, in claim 38, line 2, insert ---and--- after "arm".

Column 10, line 36, in claim 38, line 3, change "are" to ---arm---.

Column 10, line 45, in claim 41, delete double space between lines 44 and 46.

Signed and Sealed this

Thirtieth Day of June, 1992

*Attest:*

DOUGLAS B. COMER

*Attesting Officer*

*Acting Commissioner of Patents and Trademarks*